US005335845A

United States Patent [19]

Liu

[11] Patent Number: 5,335,845

[45] Date of Patent: Aug. 9, 1994

[54] PARTITIONED AND FOLDABLE PAPER FOOD CONTAINER

[76] Inventor: Yuan-Hsin Liu, 11th-1 Floor, No. 90, Fu Hsin S. Road, Sec. 1, Tah An District, Taipei, Taiwan

[21] Appl. No.: 107,991

[22] Filed: Aug. 18, 1993

[51] Int. Cl.[5] ..... B65D 5/36; B65D 5/48

[52] U.S. Cl. ..... 229/120.18; 229/117.07; 229/120.17

[58] Field of Search ..... 229/117.07, 120.13, 229/120.18, 120.21, 120.24, 114, 120.17

[56] References Cited

U.S. PATENT DOCUMENTS

| | | | |
|---|---|---|---|
| 1,926,366 | 9/1933 | Bergstein | 229/117.07 |
| 2,233,221 | 2/1941 | Olivier | 229/120.18 |
| 2,474,751 | 6/1949 | Morand | 229/120.18 |
| 2,569,733 | 10/1951 | Ringler | 229/120.13 |
| 2,833,458 | 5/1958 | Toensmeier | 229/117.07 |
| 3,297,228 | 1/1967 | Contratto | 229/120.13 |
| 3,386,644 | 6/1968 | Zackheim | 229/117.07 |
| 3,721,380 | 3/1973 | Meyers | 229/120.17 |
| 4,081,125 | 3/1978 | Meyers | 229/114 |
| 4,089,458 | 5/1978 | Meyers et al. | 229/120.24 |
| 4,757,937 | 7/1988 | Maio et al. | 229/117.07 |

*Primary Examiner*—Gary E. Elkins
*Attorney, Agent, or Firm*—Bacon & Thomas

[57] ABSTRACT

A partitioned and foldable paper food container which is suitable for containing different foods in different compartments and can be folded into a flat rectangle for easy carry and storage. The food container is made of pure fiber paper meeting FDA regulation and is formed in such a manner that the paper is first cut into a predetermined pattern, then embossed with folding lines, then folded and finally heat sealed or adhered. The food container includes a main compartment and two subsidiary compartments integrally extending from two end edges of the main compartment, whereby after folded and sealed, the subsidiary compartments can be received in the main compartment to form a partitioned food container for containing different foods in different compartments and thereby prevents the taste of the foods from mixing with one another.

1 Claim, 4 Drawing Sheets

PARTITIONED AND FOLDABLE PAPER FOOD CONTAINER

BACKGROUND OF THE INVENTION

The present invention relates to a partitioned and foldable paper food container, and more particularly to a paper food container which is suitable for separately containing different foods and can be folded into a flat body with very small volume for easy carry and storage. The food container includes a main compartment and two subsidiary compartments suitable to be received in the main compartment. The food container is seamless and leakproof, having partitions for separately containing different kinds of food and therefore preventing the taste of the foods therein from mixing with one another.

The polymer-made disposable dinner set which is currently widely used in most fast-food restaurants is easy to manufacture and economical in cost, however, it can not resist high temperature and is not subject to natural decomposition and thus tends to cause serious detriment to human health and environmental protection. Therefore, the polymer-made dinner set is gradually being substituted by a paper dinner set. The conventional paper food container, for example, can be made of paper through folding, sealing and pressing. However, most of such paper food containers have only one single compartment for containing all different kinds of food together which inevitably causes the taste of all foods to mix with one another. In addition, such paper food containers are not leakproof due to cuts, folds, or even staples used to form the containers. As a result, the function of such a food container is limited and the leak age of liquid foods out of the containers often causes inconvenience in use. Although several partitioning paper boards can be attached inside the food container to divide the same into several compartments, this is time and labor consuming and the cost therefor is relatively high. Moreover, the resulting product has an unreducible volume which causes inconvenience in transfer and storage. All of these are factors that prevent the conventional paper food containers from sharing larger market with the polymer-made food containers.

Therefore, it is necessary to improve the conventional paper food container and eliminate the above shortcomings thereof.

SUMMARY OF THE INVENTION

It is therefore a primary object of the present invention to provide a partitioned and foldable paper food container made from a single piece of paper blank which is cut into a predetermined pattern, embossed with folding lines, pressed and heat sealed or glued to form a food container. The food container includes a main compartment and two subsidiary compartments connected with the main compartment and can be received therein. The main and subsidiary compartments are all leakproof and are separately used to contain a different food so that the taste of foods would not mix with one another.

It is a further object of the present invention to provide the above food container which can be folded into a flat body with very small volume before or after use so as to facilitate the transfer of such food container and to reduce the space required to store the same.

The structure, features, functions, and other objects of the present invention, and the technical means adopted to achieve the present invention can be best understood through the following detailed description of the preferred embodiment and the accompanying drawings wherein:

DETAILED DESCRIPTION OF THE PREFERRED EMBODIMENTS

Figure 1:
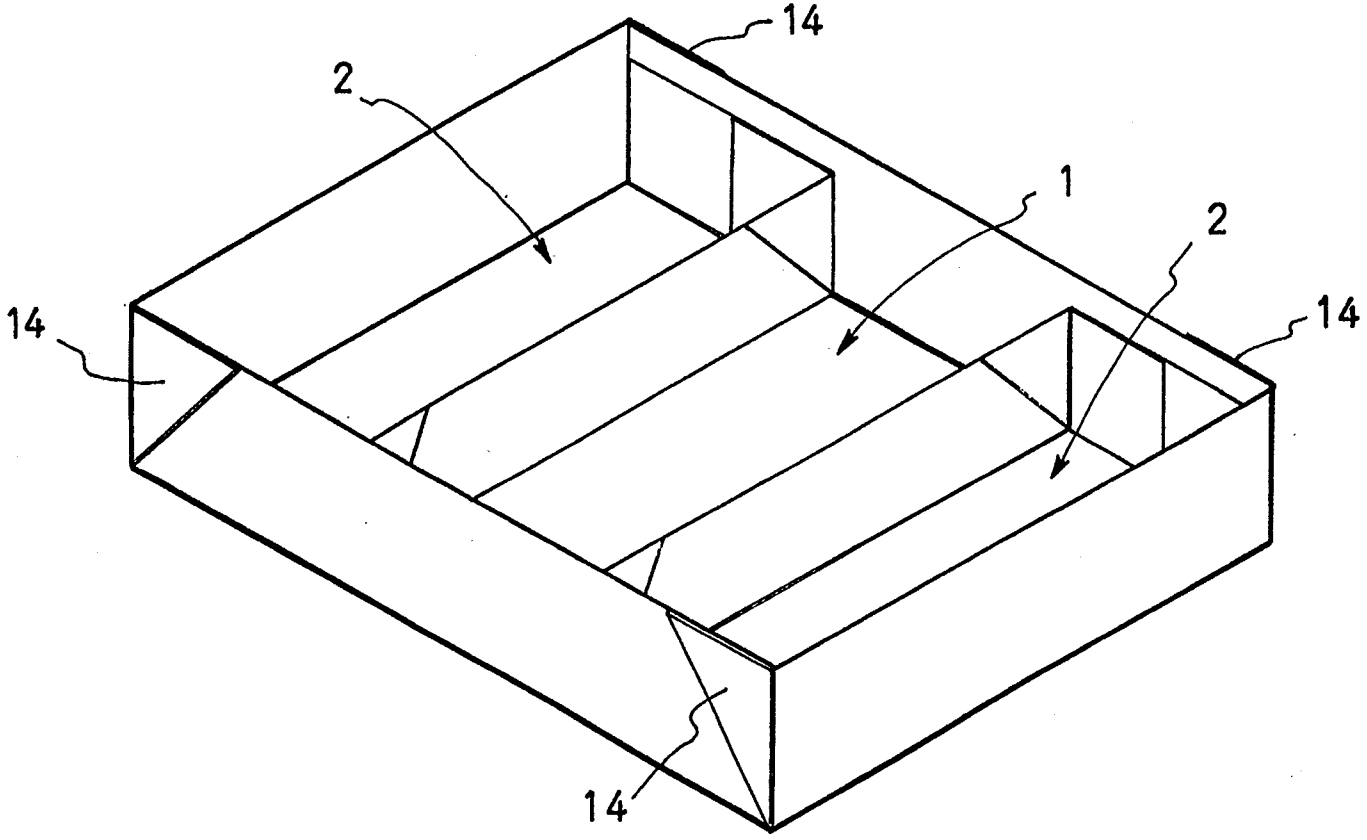
FIG. 1 is a perspective view of the present invention.

Please refer to FIG. 1. The paper food container of the present invention is composed of a main compartment 1 and two subsidiary compartments 2 formed inside the main compartment 1. Different foods can be separately contained in the main and subsidiary compartments 1 and 2.

Figure 2:
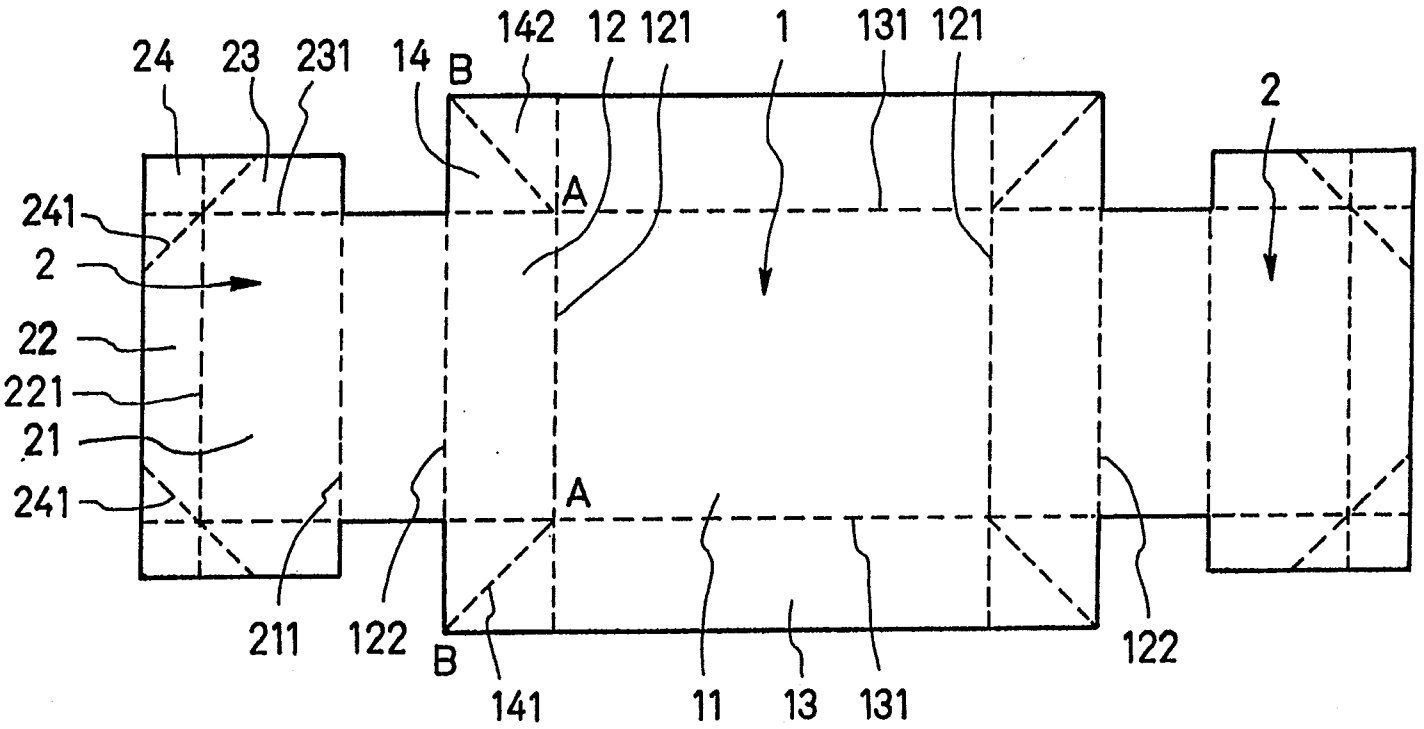
FIG. 2 is a plan view of the present invention in a flat unfolded state.
Figure 3A:
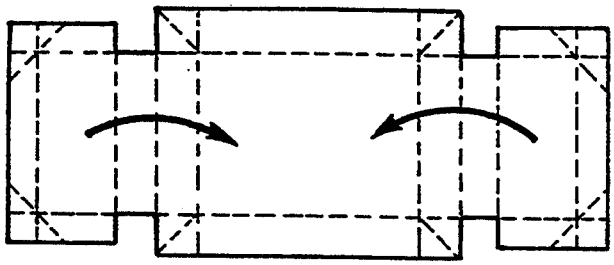
FIG. 3*a*, 3*b*, 3*c* and 3*d* show sequential folding steps for forming the food container of the present invention.
Figure 3B:
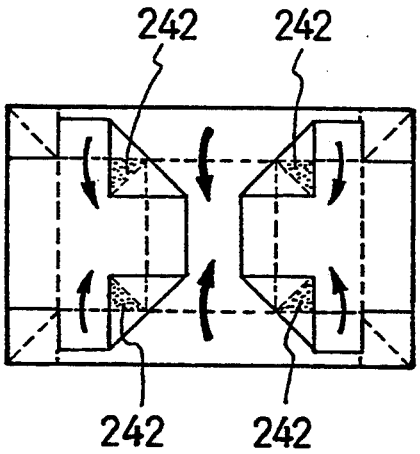
Figure 3C:
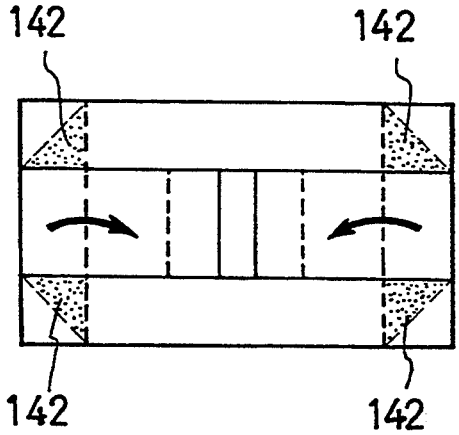
Figure 3D:
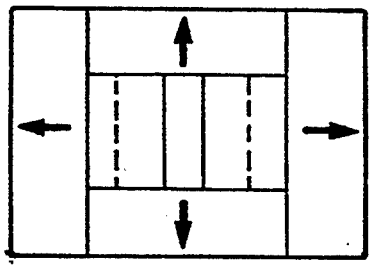
Figure 4A:
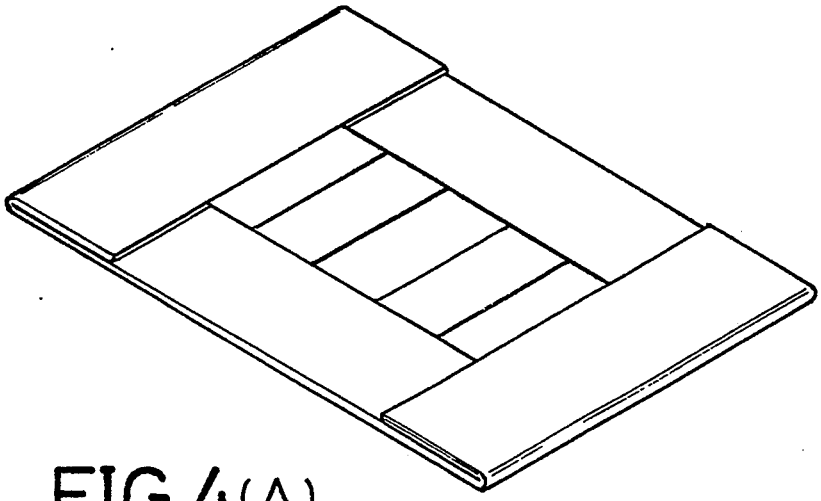
FIGS. 4*a* and 4*b* show transformation of the flat body into the food container of the present invention.
Figure 4B:
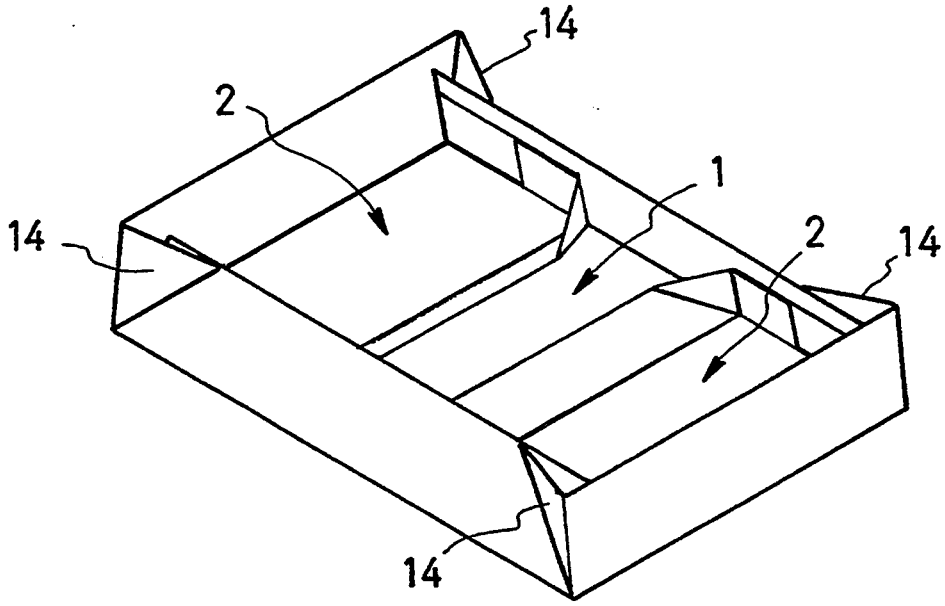

Please now refer to FIG. 2. The food container of the present invention is formed by a paper blank which is previously cut into a flat unfolded main compartment 1 and two flat unfolded subsidiary compartments 2 separately extending from both ends of the flat unfolded main compartment 1, wherein the flat unfolded main compartment 1 includes a first bottom section 11, two symmetrical second end wall sections 12 each adjoining an end of the first bottom section 11, and two symmetrical first lateral wall sections 13 each adjoining a lateral side of the first bottom section 11. A first folding line 121 is formed between the first bottom section 11 and each of the first end wall sections 12; and a second folding line 131 is formed between the first bottom section 11 and each of the first lateral wall sections 13. The first end wall sections 12 and the first lateral wall sections 13 can be folded upwardly and inward! y toward one another such that they, together with the first bottom section 11, form a box-like container. In addition, a first corner section 14 connecting each two adjacent first end wall section 12 and first lateral wall section 13 is formed with a diagonal folding line 141 extending from the joint corner A of the first end wall section 12 and the first lateral wall section 13 to the outer corner B of the flat unfolded main compartment 1, permitting the first corner sections 14 to be folded along the line 141 when the first end wall sections 12 and the first lateral wall sections 13 are folded upward, such that an adhering section 142 thereof is tightly adhered to the first lateral wall sections 13 without any cut or seam between the first sections 12 and the first sections 13. By means of the above arrangement, a seamless and leakproof box-like body is formed and capable of containing even fluid food.

A third folding line 122 is formed between the flat unfolded main compartment 1 and each of the flat unfolded subsidiary compartments 2. Each of the subsidiary compartments 2 includes a second bottom section 21, a second end wall section 22 adjoining an end edge of the second bottom section 21, two second lateral wail sections 23 each adjoining a lateral side edge of the second bottom section 21, and four second corner sections 24. A fourth folding line 221 is formed between the second bottom section 21 and each of the second end wall sections 22. To form a folded subsidiary compartment 2, first fold each of the flat unfolded subsidiary compartments 2 along the third folding line 122 such that they are bent upward and inward until they are pressed against the main compartment 1, as shown in FIG. 3 (A); then, as shown in FIG. 3 (B), fold the four second corner sections 24 and a part of the two outer second end wall sections 22 and a part of the second lateral wall sections 23 along a fifth folding line designated as 241 such that the four second corner sections 24 are turned upward and backward to press against the backside of the inward folded subsidiary compartments 2. Meanwhile, as shown in FIG. 3 (C), fold each of the second lateral wall sections 23 of the subsidiary compartments 2 along a sixth folding line designated as 231, such that each of them is tightly pressed against a second adhering section 242 of each second corner section 24. Then, the first end wall sections 12 of the main compartment 1 are folded inwardly toward each other with each of the adhering sections 142 of the main compartment 1 adhered to the corresponding first lateral wall sections 13, as shown in FIG. 3 (D), to form a flat rectangular box body.

When in use, the first end wall sections 12 and the first lateral wall sections 13 of the main compartment 1 are unfolded outward into an upright state to form a partitioned paper food container for containing different foods in separate compartments.

The paper food container according to the present invention can be folded for easy storage or collection before or after it is used, respectively. To collapse a used paper food container of the present invention, first fold the first lateral wall sections 13 of the main compartment 1 inwardly and then fold the first end wall sections 12 inwardly. At this time, the second end wall sections 22 of the subsidiary compartments 2 automatically collapse outward along with the first end wall sections 12 of the main compartment 1. As a result, the whole food container is transformed into a flat rectangle with a very small volume that facilitates the transfer of the food container and reduces the storage space thereof, and therefore, meets the requirement of environment protection.

According to the above arrangements, the food container of the present invention is leakproof and heat-resistant. Moreover, the food container can be conveniently used without occupying much space.

It is to be understood that the above description and drawings are only used for illustrating one embodiment of the present invention, not intended to limit the scope of the present invention. Any variation and derivation from the above description and drawings should be included in the scope of the present invention.

What is claimed is:

1. A paper blank foldable into a partitioned container having multiple compartments, the paper blank having a pattern comprising:

a) a main compartment defined by a main bottom section, a pair of first end wall sections, each first end wall section adjoining an end edge of the main bottom section at a first folding line, a pair of first lateral wall sections, each first lateral wall section adjoining a lateral edge of the main bottom section at a second folding line, and four first corner sections, each first corner section connecting an adjacent first end wall section and an adjacent first lateral wall section, each first corner section including a diagonal folding line for permitting the corner section to fold and form a first adhering section for adhering to the adjacent lateral wall section and form a box body; and b) a pair of subsidiary compartments, each subsidiary compartment defined by a subsidiary bottom section adjoined to a first end wall section at a third folding line, a second end wall section adjoining an end edge of the subsidiary bottom section at a fourth folding line, a pair of second lateral wall sections, each second lateral wall section adjoining a lateral edge of a subsidiary bottom section at a fifth folding line; and c) each subsidiary bottom section including a pair of second corner sections, each second corner section connecting the adjacent second end wall section and a second lateral wall section, and a sixth folding line extending diagonally across the adjacent second end wall section and each second lateral wall section for permitting the second corner section to fold inwardly and form a second adhering section for adhering to the adjacent second lateral wall section.

* * * * *